US010321215B2

(12) United States Patent
Guo et al.

(10) Patent No.: US 10,321,215 B2
(45) Date of Patent: Jun. 11, 2019

(54) EARPHONE

(71) Applicant: GOERTEK INC., Weifang, Shandong (CN)

(72) Inventors: Tonghui Guo, Shandong (CN); Qigao Chen, Shandong (CN); Jiangtao Xu, Shandong (CN)

(73) Assignee: GOERTEK INC., Weifang, Shandong (CN)

( * ) Notice: Subject to any disclaimer, the term of this patent is extended or adjusted under 35 U.S.C. 154(b) by 0 days.

(21) Appl. No.: 15/771,405

(22) PCT Filed: Jun. 1, 2016

(86) PCT No.: PCT/CN2016/084231
§ 371 (c)(1),
(2) Date: Apr. 27, 2018

(87) PCT Pub. No.: WO2017/075985
PCT Pub. Date: May 11, 2017

(65) Prior Publication Data

US 2018/0332378 A1 Nov. 15, 2018

(30) Foreign Application Priority Data

Nov. 3, 2015 (CN) ..... 2015 2 0869455 U

(51) Int. Cl.
*H04R 1/10* (2006.01)
*H04R 5/033* (2006.01)

(52) U.S. Cl.
CPC ..... *H04R 1/10* (2013.01); *H04R 1/1008* (2013.01); *H04R 1/1016* (2013.01); *H04R 5/033* (2013.01)

(58) Field of Classification Search
CPC combination set(s) only.
See application file for complete search history.

(56) References Cited

U.S. PATENT DOCUMENTS

2005/0105755 A1* 5/2005 Yueh ..... H04R 1/1041 381/371
2008/0013773 A1 1/2008 Yang
2010/0061580 A1* 3/2010 Tiscareno ..... H04R 1/1016 381/380

FOREIGN PATENT DOCUMENTS

CN 203840497 U 9/2014
CN 203851264 U * 9/2014
(Continued)

OTHER PUBLICATIONS

International Search Report of the ISA/CN, dated Jul. 26, 2016.

*Primary Examiner* — Sunita Joshi
(74) *Attorney, Agent, or Firm* — Patshegen IP LLC; Moshe Pinchas

(57) ABSTRACT

The present invention provides an earphone, comprising an earphone housing, a speaker cover, a sound emitting tube, and a speaker, wherein the earphone further includes a tuning baffle disposed inside the speaker cover, wherein a sound emitting hole, a sound outlet hole and mode slots are disposed on the speaker cover, and the sound emitting tube is connected to the tuning baffle through the sound emitting hole, a mode protrusion and a tuning hole are disposed on the tuning baffle, and the mode protrusion is limited by different mode slots by rotating the tuning baffle via the sound emitting tube, so as to adjust the sound outlet area of the sound outlet hole. By utilizing the above-mentioned invention, it is possible to adjust the mid-bass frequency response of the earphone so that a single type earphone can exhibits different sound characteristics.

7 Claims, 7 Drawing Sheets

(56) References Cited

FOREIGN PATENT DOCUMENTS

| | | | |
|---|---|---|---|
| CN | 203851264 | U | 9/2014 |
| CN | 104185102 | A | 12/2014 |
| CN | 205123957 | U | 3/2016 |

* cited by examiner

EARPHONE

TECHNICAL FIELD

The present invention relates to the technical field of acoustics, and more specifically, to an earphone.

BACKGROUND ART

With the widespread use of high-quality smart phones, Pads and other portable electronic products, people have increasingly higher requirements for earphones that can be cooperatively used with them. These earphones are required to be small in size and, meanwhile, have high fidelity acoustical quality performance reproducing a variety of sound effects. In addition, for any kind of the above-mentioned electronic products, in order to allow users to listen to the sound signals provided by electronic products without disturbing others, the earphone has become a necessary accessory for each electronic product. In addition, the earphone also provides a better sound transmission for the listener, so that the listener can clearly hear and understand the content of the sound signals.

The existing earphones can be classified into in-ear earphones, on-ear earphones, and half in-ear earphones according to different wearing manners. The earphone mainly includes a front housing, a rear housing, and a speaker received inside of the front and rear housings of the earphone. Different users have different preferences for the frequency response of the earphone, and it is also necessary to adjust the frequency response of the earphone according to different using environments to meet the users' needs. Therefore, there is a need for an earphone that can adjust the frequency response of the earphone according to individual needs, so that a single type of earphone can exhibit different musical styles, so as to adapt to different users and using environments.

SUMMARY OF THE INVENTION

In view of the above problems, the purpose of the present invention is to provide an earphone to solve the current contradiction between the fact that a single type of earphone can only exhibit one kind of acoustic characteristic and the fact that the different users have different requirements on the acoustical quality of the earphone.

The earphone provided by the present invention comprises an earphone housing, a speaker cover adapted and connected to the earphone housing, a sound emitting tube disposed outside the speaker cover, and a speaker received in a cavity defined by the earphone housing and the speaker cover, wherein the earphone further includes a tuning baffle disposed inside the speaker cover, wherein a sound emitting hole, a sound outlet hole and mode slots are disposed on the speaker cover, and the sound emitting tube is connected to the tuning baffle through the sound emitting hole; a mode protrusion and a tuning hole are disposed on the tuning baffle, and the mode protrusion is limited by the mode slots; and the mode protrusion is limited by different mode slots by rotating the tuning baffle via the sound emitting tube, so as to adjust a sound outlet area of the sound outlet hole. In addition, a preferred structure is that the mode slots include a first mode slot and a second mode slot, wherein when the mode protrusion is limited by the first mode slot, the position of the tuning hole corresponds to the position of the sound outlet hole; and when the mode protrusion is limited by the second mode slot, the position of the tuning hole and the position of the sound outlet hole are misaligned.

In addition, a preferred structure is that a stop block is disposed on the speaker cover, and a notch is disposed on the tuning baffle; and the stop block is located in the notch to control the rotation angle of the sound emitting tube.

In addition, a preferred structure is that the earphone further comprises a sealing ring, wherein a sealing ring receiving groove is disposed on the speaker cover, and the sealing ring is disposed between the speaker cover and the tuning baffle, and is fixed in the sealing ring receiving groove; and the sealing ring is provided with a through hole at a position corresponding to the position of the sound outlet hole.

In addition, a preferred structure is that the earphone further includes a damping mesh, wherein the damping mesh is attached to an end of the sound emitting tube away from the speaker cover.

In addition, a preferred structure is that the earphone further includes an in-ear rubber sleeve, wherein the in-ear rubber sleeve is sleeved at an end of the sound emitting tube away from the speaker cover.

In addition, a preferred structure is that the earphone further includes an earphone cable and an earphone cable fixing portion, wherein one end of the earphone cable is electrically connected to the speaker through the earphone cable fixing portion, and the other end of the earphone cable is provided with an earphone plug.

It can be known from the above technical solutions that the earphone of the present invention is provided with a tuning baffle fixedly connected to the sound emitting tube inside the speaker cover, and the tuning baffle is rotated by rotating the sound emitting tube to adjust the relative position of the sound outlet hole on the speaker cover and the tuning hole on the tuning baffle, thereby changing the sound outlet area of the sound outlet hole to finally realize changing the mid-bass sound in the earphone, so that the earphone can exhibit different musical styles, and is simple in structure, low in cost and easy to adjust.

BRIEF DESCRIPTION OF THE DRAWINGS

Other objects and effects of the present invention will be more explicit and readily to be understood by referring to the following description with reference to the accompanying drawings and the contents of claims, along with further understanding of the present invention. In the drawing:

FIG. 2-1 is a top view of the sealing ring according to an embodiment of the present invention;

FIG. 2-2 is a bottom view of the sealing ring according to an embodiment of the present invention;

FIG. 3-1 is a top view of the tuning baffle according to an embodiment of the present invention;

FIG. 3-2 is a side view of the tuning baffle according to an embodiment of the present invention;

FIG. 4-1 is a bottom view of a speaker cover according to an embodiment of the present invention;

FIG. 4-2 is a sectional view taken along line A-A of FIG. 4-1;

FIG. 5-1 is a side view of the sound emitting tube according to an embodiment of the present invention;

FIG. 5-2 is a sectional view taken along line A-A of FIG. 5-1;

FIG. 6-1 is a first schematic diagram of an assembly structure of the sound emitting tube and the speaker cover according to an embodiment of the present invention;

FIG. 6-2 is a sectional view taken along line A-A of FIG. 6-1;

FIG. 6-3 is a bottom view of FIG. 6-1;

Figure 1:
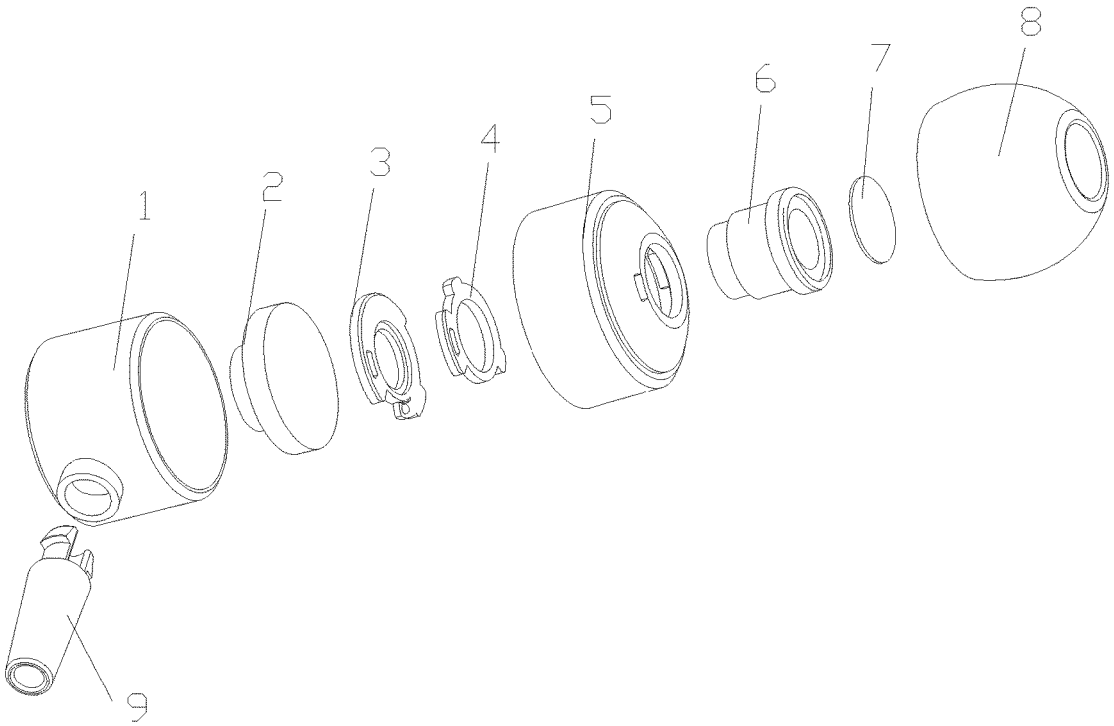
FIG. 1 is an exploded view of the earphone according to an embodiment of the present invention.

The reference numerals in the drawings: earphone housing 1, speaker 2, tuning baffle 3, tuning hole 31, mode protrusion 32, notch 33, sealing ring 4, through hole 41, speaker cover 5, sound outlet hole 51, the first mode slot 521, the second mode slot 522, the stopper block 53, the sound emitting tube 6, the damping mesh 7, the in-ear rubber sleeve 8, and the earphone cable fixing portion 9.

The same reference numbers indicate similar or corresponding structures or functions throughout the drawings.

DETAILED DESCRIPTION OF THE EMBODIMENTS

In the following description of specific embodiments of the present invention: the sound emitting hole is a hole disposed on the speaker cover communicating with the sound emitting tube; the sound outlet hole is a hole disposed on the speaker cover close to the sound emitting hole, the tuning hole is a hole disposed on the tuning baffle for adjusting the size of the sound outlet hole communicating with external; by collaboration between the tuning hole and the sound outlet hole, the size of the hole (including the sound emitting tube and the sound outlet hole) communicating the front sound cavity of the earphone with the external is changed. In order to obtain a variety of sound effects, according to an embodiment of the present invention, the relative position between the tuning baffle and the speaker cover is adjusted, the size of the sound outlet hole is adjusted by the tuning hole, and thus the size of the aperture of the earphone through which sound is emitted to the outside is changed, and finally, the earphone therefore can exhibit different musical styles.

To describe the earphone structure of the present invention in detail, specific embodiments of the present invention will be described in detail below with reference to the accompanying drawings.

FIG. 1 shows an exploded structure of the earphone according to an embodiment of the present invention.

As shown in FIG. 1, the earphone according to an embodiment of the present invention includes: an earphone housing 1, a speaker cover 5 that is adapted and connected to the earphone housing 1, a sound emitting tube 6 disposed outside the speaker cover 5, a speaker 2 received in the cavity formed by the earphone housing 1 and the speaker cover 5, and a tuning baffle 3 disposed inside the speaker cover 5; wherein the speaker cover 5 is provided with a sound emitting hole, a sound outlet hole, and a mode slot, and the sound emitting tube 6 is connected with the tuning baffle 3 though the sound emitting hole; the mode protrusion and the tuning hole are disposed on the tuning baffle 3, and the mode protrusion is limited by the mode slots; the sound emitting tube 6 is rotated with respect to the speaker cover 5 to drive the tuning baffle 3 rotates inside the speaker cover 5 so that the mode protrusion is limited by different mode slots, and finally, the sound outlet area of the sound outlet hole is adjusted by the tuning hole; wherein the speaker 2 is disposed on the side of the tuning baffle 3 away from the speaker cover 5, and the speaker 2 divides the cavity formed by the earphone housing 1 and the speaker cover 5 into a front sound cavity and a rear sound cavity. When the positions of the tuning hole and the sound outlet hole correspond to each other, the sound outlet hole and the tuning hole are intercommunicated. At this time, the area of the hole communicating the front sound cavity of the earphone with external is the sum of the area of the sound outlet hole and the area the through hole of the sound emitting tube 6 (relates to the cylinder diameter of the sound emitting tube 6; when the positions of the tuning hole and the sound outlet hole are misaligned, the sound outlet hole is blocked by the tuning baffle 3, and the area of the hole communicating the front sound cavity of the earphone with external is only corresponding to the area of the through hole of the sound emitting tube 6. It can be seen that, by rotating the sound emitting tube 6, the tuning baffle 3 can be located at different positions, thus the size of the sound outlet hole can be controlled, so that the mid-low frequency response of the earphone can be adjusted and the earphone can exhibit different music styles.

In order to prevent air leakage due to the untight connection between the tuning baffle 3 and the speaker cover 5, which affects the acoustic performance of the earphone, in a specific embodiment of the present invention, a sealing ring 4 is provided between the tuning baffle 3 and the speaker cover 5. Since the sealing ring 4 is provided, firstly, the sealing performance between the tuning baffle and the speaker cover can be improved, which ensures that the acoustic performance of the earphone is stable; secondly, friction between the tuning baffle and the speaker cover can be reduced during the process of rotating the sound emitting tube 6, which can improve the service life of the product.

Specifically, in order to describe the structures of the sealing ring, the tuning baffle, the speaker cover, etc. of the present invention in detail, they will be described in detail by referring to the drawings, respectively.

Figures 1, 2:
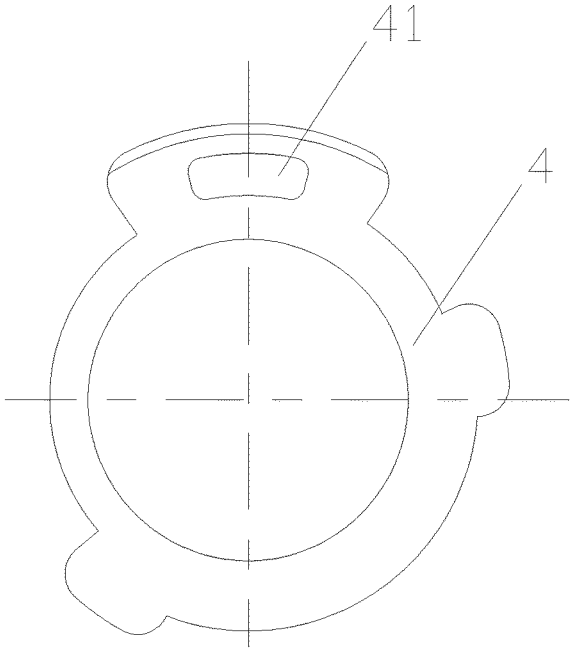
Figure 2:
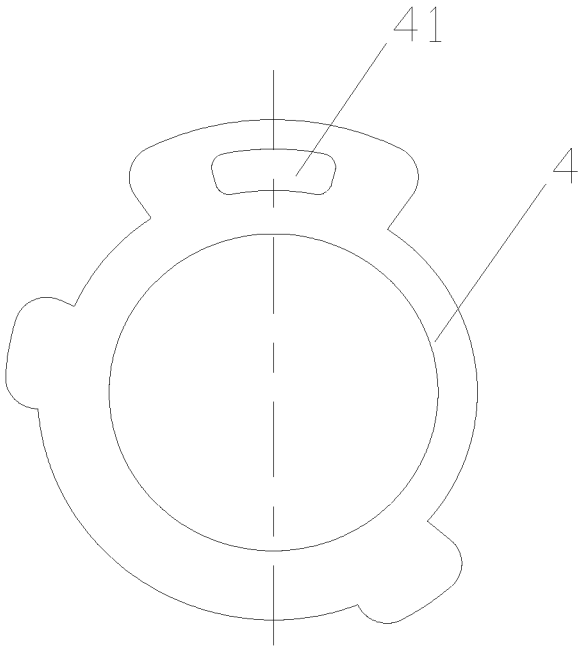

FIGS. 2-1 and 2-2 respectively show a top view and a bottom view of the sealing ring according to an embodiment of the present invention.

As shown in FIG. 2-1 and FIG. 2-2, the structure of the sealing ring 4 of the embodiment of the present invention is adapted to the structure of the tuning baffle, and the sealing ring 4 is provided with a through hole 41 at the position corresponding to the sound outlet hole; in addition, a sealing ring receiving groove corresponding to the structure of the sealing ring 4 is provided at the inner side of the speaker cover, and the sealing ring 4 is located between the speaker cover and the tuning baffle and fixed in the sealing ring receiving groove. The sealing performance between the tuning baffle and the speaker cover is improved by the sealing ring 4, so as to ensure that the acoustic performance of the earphone is stable; and the friction between the tuning baffle and the speaker cover can be reduced during the process of rotating the sound emitting tube, so as to improve product life and user experience.

Figures 1, 3:
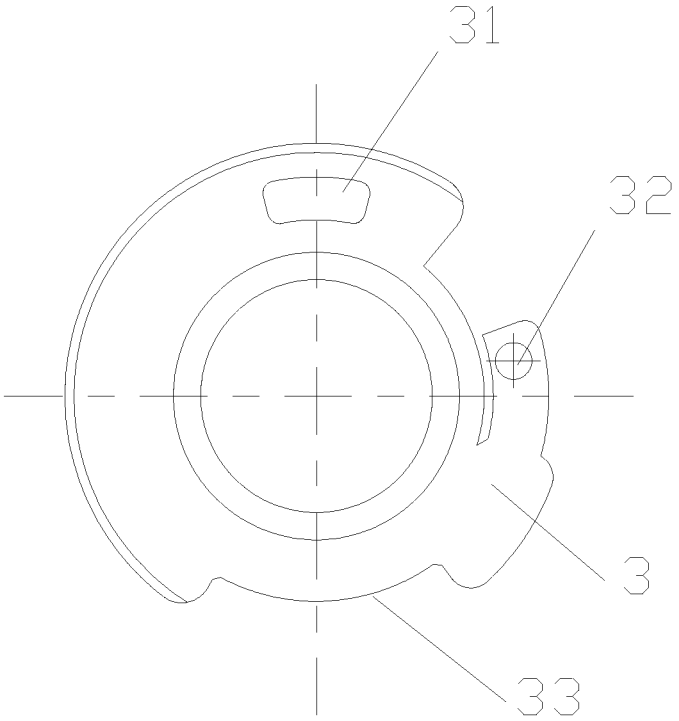
Figures 2, 3:
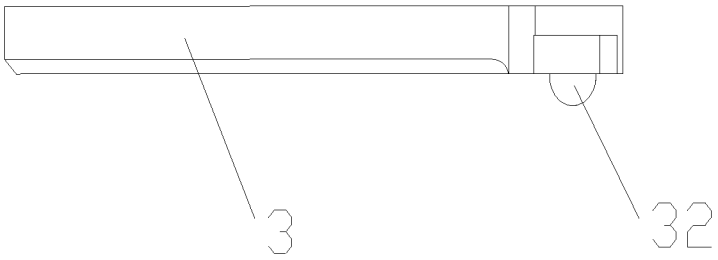

FIGS. 3-1 and 3-2 respectively illustrate a top view and a side view of the structure of a tuning baffle according to an embodiment of the present invention.

As shown in FIG. 3-1 and FIG. 3-2, according to an embodiment of the present invention, the tuning baffle 3 is fixedly connected with the sound emitting tube, and the tuning baffle 3 can be rotated by rotating the sound emitting tube; wherein the tuning baffle 3 is an annular structure, on which a tuning hole 31 and a mode protrusion 32 are provided; the mode protrusion 32 is limited by different mode slots by rotating the sound emitting tube, so as to adjust the overlap between the sound emitting hole and the sound outlet hole to various degrees.

In addition, in order to effectively control the rotation angle of the sound emitting tube, a notch 33 may be provided on the tuning baffle 3, and the rotation angle of the sound emitting tube is controlled by the notch 33 cooperating with the stopper block on the speaker cover, so as to avoid that the mode protrusion 32 slides out from the mode slot or the slide way, causing wear of the mode protrusion.

Figures 1, 4:
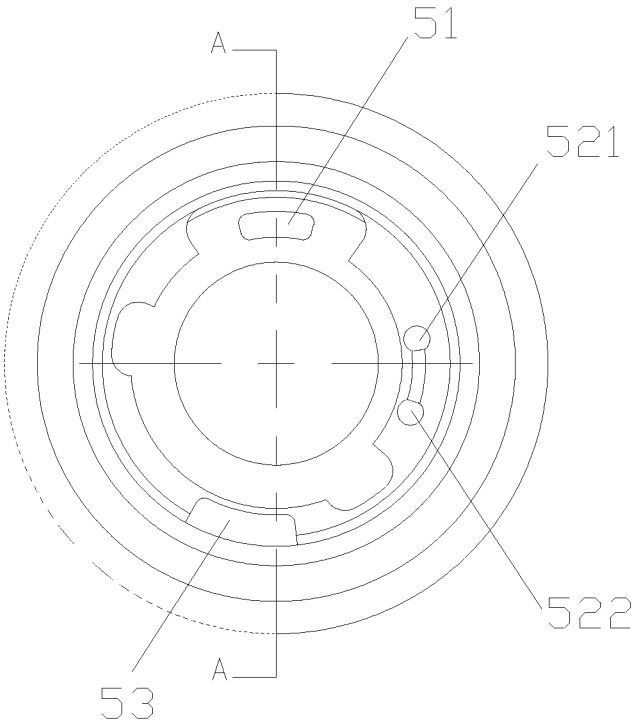
Figures 2, 4:
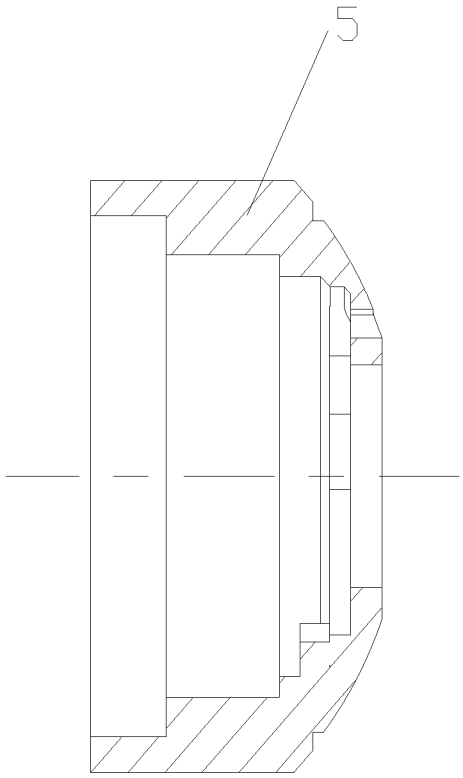

FIG. 4-1 and FIG. 4-2 respectively show a bottom view structure of a speaker cover and a sectional structure taken along line A-A according to an embodiment of the present invention.

As shown in FIGS. 4-1 and 4-2, the speaker cover 5 of an embodiment of the present invention includes a sealing ring receiving groove (not shown), a sound outlet hole 51, and a mode slot adapted to the mode protrusion of the tuning baffle, wherein an arc-shaped slide way is disposed between the mode slots to facilitate the free switching of the mode protrusion of the tuning baffle between different mode slots. It can be seen that the arc of the side way is consistent with the trajectory of the mode protrusion.

In the present embodiment, the case where there are two mode slots is described, i.e., the first mode slot 521 and the second mode slot 522, rotating the sound emitting tube, so that the mode protrusion of the tuning baffle is limited by the first mode slot 521 and the position of the tuning hole corresponds to that of the sound outlet hole 51, at this time, the sound outlet hole 51 is completely opened, and the hole communicating the front sound cavity of the earphone with external is maximized; rotating the sound emitting tube again, so that the mode protrusion of the tuning baffle is limited by the second mode slot 522 and the positions of the tuning hole and the sound outlet hole 51 are misaligned, at this time, the sound outlet hole 51 is blocked by the sound baffle, and the size of the hole communicating the front sound cavity of the earphone with external is only the size of the through hole of the sound emitting tube, that is, the hole communicating the front sound cavity of the earphone with external is the smallest.

It should be noted that, in the earphone of the present invention, the number of slot slots can also be more than two, and arc-shaped slide ways can be set between the adjacent mode slots. The sound baffle is located in different mode slots by rotating the sound emitting tube, and the aperture area of the sound outlet hole 51 is adjusted between the maximum and minimum values, so that the earphone exhibits a variety of different musical styles.

In addition, in order to cooperate with the notch on the tuning baffle, a stopper block 53 can also be provided on the speaker cover 5. The stopper block 53 is disposed in the notch of the tuning baffle, and during the rotation of the tuning baffle, the rotation angle of the sound emitting tube can be controlled by the contacting between the notch of the tuning baffle and the stopper block 53.

Figures 1, 5:
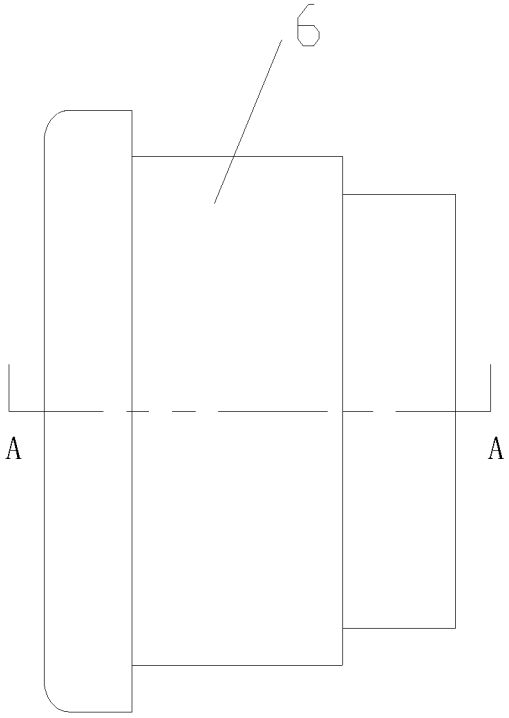
Figures 2, 5:
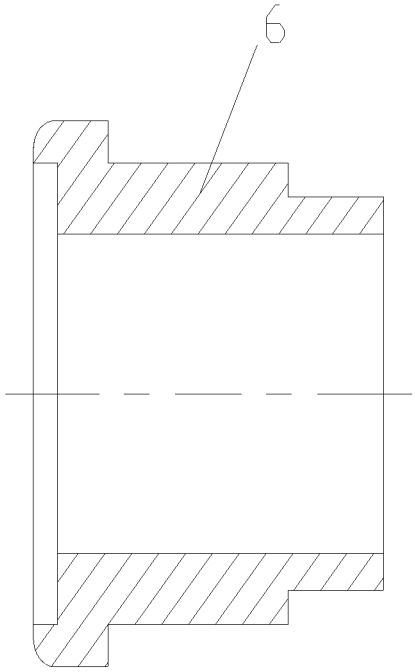

FIGS. 5-1 and 5-2 respectively show a side view and a sectional view taken along line A-A of the structure of the sound emitting tube according to an embodiment of the present invention.

As shown in FIG. 5-1 and FIG. 5-2, the sound emitting tube 6 of the embodiment of the present invention is a stepped cylindrical hollow structure communicating the front sound cavity of the earphone with external, one end of the sound emitting tube is connected with the external earphone sleeve or in-ear rubber sleeve, and the other end of the sound emitting tube is fixed at the sound emitting hole of the speaker cover and fixedly connected to the tuning baffle inside the speaker cover. By rotating the sound emitting tube 6 on the speaker cover, the tuning baffle can be driven to rotate, so as to control the size of the sound outlet hole on the speaker cover.

FIGS. 6-1, 6-2, and 6-3 respectively illustrate a first diagram, a sectional view taken alone line A-A and a bottom view of an assembly structure of the sound emitting tube and the speaker cover according to an embodiment of the present invention.

Figures 1, 6:
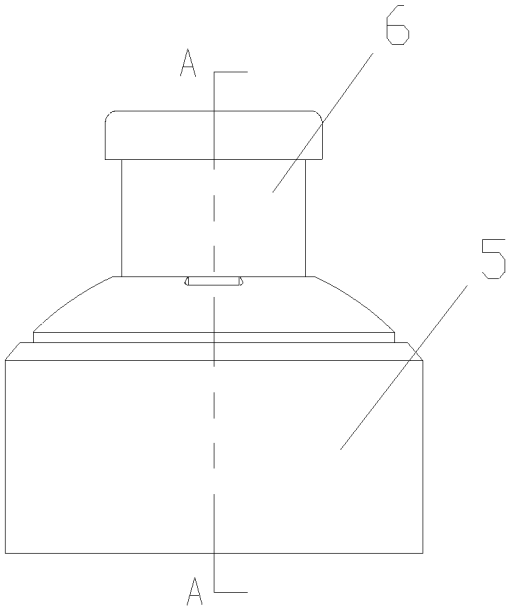
Figures 2, 6:
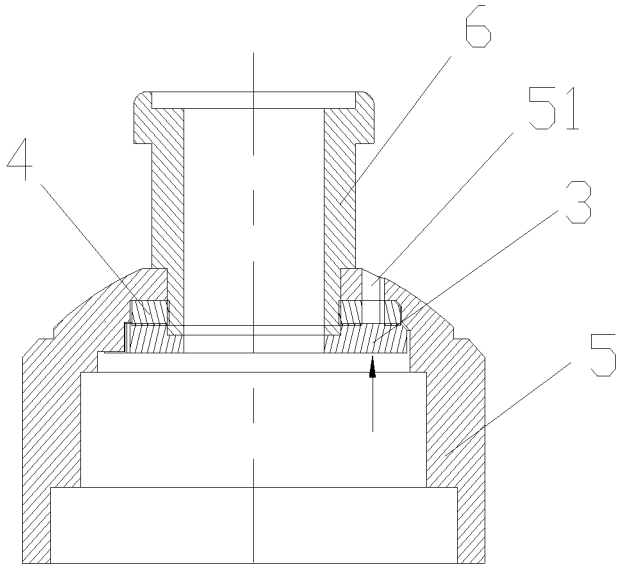
Figures 3, 6:
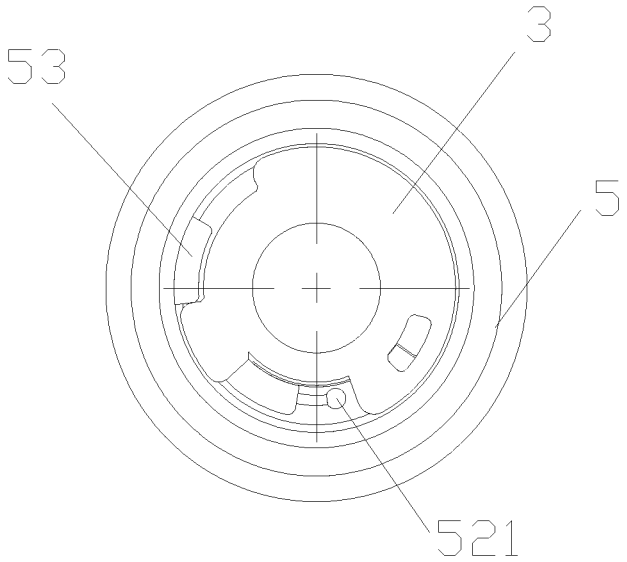

As shown in FIG. 6-1 to FIG. 6-3, in a state in which the sound emitting tube 6 and the speaker cover 5 according to the embodiment of the present invention are assembled, the mode protrusion of the tuning baffle 3 is rotated to the second mode slot. In this case, the tuning hole is misaligned with the sound outlet hole 51 and the through hole of the sealing ring 4. The direction indicated by the arrow in FIG. 6-2 indicates the direction of the sound. In this case, the sound outlet hole 51 is closed, and the sound is emitted from the sound emitting tube 6.

Figure 7:
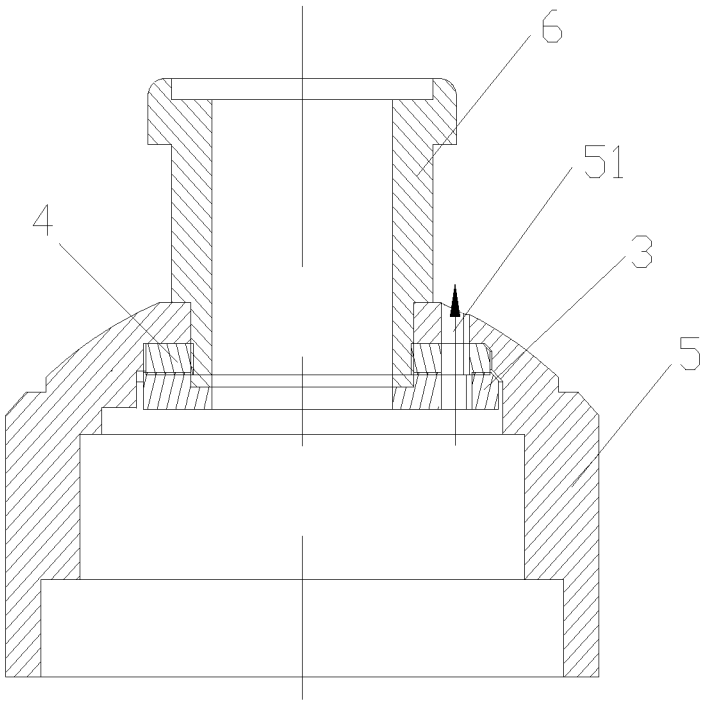
FIG. 7 is a second schematic diagram of an assembly structure of the sound emitting tube and the speaker cover according to an embodiment of the present invention.

FIG. 7 illustrates a second assembly structure of the sound emitting tube and the speaker cover according to an embodiment of the present invention.

As shown in FIG. 7, in another state in which the sound emitting tube 6 and the speaker cover 5 according to the embodiment of the present invention are assembled, the sound emitting tube 6 is further rotated on the basis of the situation as shown in FIG. 6-2, so that the mode protrusion of the tuning baffle 3 passes through the second mode slot and the arc slide way between the first mode slot and the second mode slot and slides into the first mode slot. In this case, the tuning hole, the sound outlet hole 51 and the through hole of the sealing ring 4 are intercommunicated to each other. The direction indicated by the arrow in FIG. 7 indicates the direction of the sound. In this case, the sound outlet hole 51 is opened and the sound is emitted from the sound emitting tube 6 and the sound outlet hole 51 at the same time.

As shown in FIG. 1, in another embodiment of the present invention, the earphone may further include a damping mesh 7, an in-ear rubber sleeve 8, an earphone cable, and an earphone cable fixing portion 9 for fixing the earphone cable; wherein the damping mesh 7 is attached on an end of the sound emitting tube away from the speaker cover; the setting of the damping mesh 7 can not only block the external small particles from entering into the earphone, but also can adjust the acoustic performance of the earphone; the in-ear rubber sleeve 8 is disposed on an end of the sound emitting tube away from the speaker cover, the in-ear rubber sleeve 8 can be made of a material such as silicone or high-elasticity polyester, and so on. When the in-ear rubber sleeve is inserted into the ear canal, it can be in close contact with the ear canal to isolate the sound from entering the middle ear and the inner ear to achieve the purpose of sound isolation. In addition, the earphone cable fixing portion 9 is fixedly connected with the earphone housing, one end of the earphone cable is connected with the speaker through the earphone cable fixing portion 9, and the other end is provided with an earphone plug, which is used in conjunction with an external portable electronic product.

In addition, the speaker 2 of the embodiment of the present invention includes a speaker unit housing and a vibration system and a magnetic circuit system accommodated in the speaker unit housing. The magnetic circuit system includes a magnetic yoke, a magnet located at a central position of the magnetic yoke, a washer located at a side of the magnet away from the magnetic yoke. The vibration system includes a diaphragm, a voice coil fixed on one side of the diaphragm, and a reinforcing portion located at the center of the diaphragm.

It can be seen from the above embodiments that, according to the earphone provided by the present invention, a tuning baffle connected to the sound emitting tube is disposed inside the speaker cover, and the tuning baffle is rotated by rotating the sound emitting tube to block the sound outlet hole on the speaker cover to various degree by the tuning baffle and the tuning hole on the tuning baffle, thereby adjusting the area of the hole communicating the front sound cavity of the earphone with external, and thus changing the frequency response of the earphone and thus the earphone can exhibit different musical styles, and is simple in structure, convenient to operate, and have good user experience.

The earphone provided by the present invention is described above by way of example with reference to the accompanying drawings. However, those skilled in the art should understand that, for the earphone provided by the present invention described above, various improvements can be made without departing from the content of the present invention. Therefore, the scope of protection of the present invention should be determined by the contents of the appended claims.

The invention claimed is:

1. An earphone comprising an earphone housing, a speaker cover adapted and connected to the earphone housing, and a speaker received in a cavity defined by the earphone housing and the speaker cover, wherein the earphone further includes a tuning baffle disposed inside the speaker cover and a sound emitting tube disposed outside the speaker cover;

wherein the speaker cover defines a sound emitting hole configured such that the sound emitting tube is rotatably disposed inside the sound emitting hole and is connected to the tuning baffle through the sound emitting hole;

wherein said speaker cover further defines, a sound outlet hole and at least two mode slots and the tuning baffle defines a mode protrusion and a tuning hole; and wherein the tuning baffle is rotatable with respect to the speaker cover by rotating the sound emitting tube disposed inside the sound emitting hole so as to adjust a sound outlet area of the sound outlet hole and wherein the rotation of the tuning baffle causes the mode protrusion to be limited by different mode slots.

2. The earphone of claim 1, wherein the mode slots include a first mode slot and a second mode slot, wherein when the mode protrusion is limited by the first mode slot, a position of the tuning hole corresponds to a position of the sound outlet hole; and when the mode protrusion is limited by the second mode slot, the position of the tuning hole and the position of the sound outlet hole are misaligned.

3. The earphone of claim 1, wherein a stop block is disposed on the speaker cover, and a notch is disposed on the tuning baffle; and the stop block is located in the notch to control a rotation angle of the sound emitting tube.

4. The earphone of claim 1, further comprising a sealing ring, wherein a sealing ring receiving groove is disposed on the speaker cover, and the sealing ring is disposed between the speaker cover and the tuning baffle and is fixed in the sealing ring receiving groove; and the sealing ring is provided with a through hole at a position corresponding to a position of the sound outlet hole.

5. The earphone of claim 1, further comprising a damping mesh, wherein the damping mesh is attached to an end of the sound emitting tube away from the speaker cover.

6. The earphone of claim 1, further comprising an in-ear rubber sleeve, wherein the in-ear rubber sleeve is sleeved at an end of the sound emitting tube away from the speaker cover.

7. The earphone of claim 1, further comprising an earphone cable and an earphone cable fixing portion, wherein one end of the earphone cable is electrically connected to the speaker through the earphone cable fixing portion, and another end of the earphone cable is provided with an earphone plug.

* * * * *